US005967416A

United States Patent [19]

Barbour

[11] Patent Number: 5,967,416

[45] Date of Patent: Oct. 19, 1999

[54] WATER ACTIVATED POP-UP SPRINKLER

[76] Inventor: Wayne W. Barbour, 4627 Abrijo Rd, Cameron Park, Calif. 95682

[21] Appl. No.: 09/044,316

[22] Filed: Mar. 19, 1998

[51] Int. Cl.[6] ..... B05B 15/10

[52] U.S. Cl. ..... 239/205; 239/276; 239/279

[58] Field of Search ..... 239/205, 204, 239/203, 276, 279–281

[56] References Cited

U.S. PATENT DOCUMENTS

| | | | |
|---|---|---|---|
| 2,315,911 | 4/1943 | Truedson | 239/205 |
| 2,399,112 | 4/1946 | Glover | 239/205 |
| 4,099,670 | 7/1978 | Cole et al. | 239/205 |
| 4,234,125 | 11/1980 | Lieding | 239/205 |
| 4,834,289 | 5/1989 | Hunter | 239/205 |

*Primary Examiner*—Andres Kashnikow
*Assistant Examiner*—Dinh Q. Nguyen

[57] ABSTRACT

A new water activated pop-up sprinkler for allowing for low volume irrigation of lawns and gardens. The inventive device includes a cylindrical housing having an open upper end, a closed lower end, a cylindrical side wall therebetween, and a hollow interior. The closed lower end has a tapered pointed end extending downwardly therefrom for penetrating a ground surface. The cylindrical housing has diametrically opposed inlet and outlet connections disposed on the cylindrical side wall downwardly of the open upper end. The connections each have channels extending downwardly within the cylindrical side wall to the closed lower end and meeting centrally within the closed lower end wherein a short channel extending upwardly into communication with the hollow interior. An inner plastic pipe is provided having opposed open ends. A lower open end couples with the short channel of the cylindrical housing. The plastic pipe has a spring disposed therearound. The spring biases the plastic pipe downwardly with respect to the cylindrical housing. A spray nozzle is coupled with an open upper end of the inner plastic pipe. A cap is dimensioned for coupling with the cylindrical housing. The cap has an aperture therethrough dimensioned for receiving the spray nozzle therethrough.

5 Claims, 2 Drawing Sheets

WATER ACTIVATED POP-UP SPRINKLER

BACKGROUND OF THE INVENTION

1. Field of the Invention

The present invention relates to sprinkler systems and more particularly pertains to a new water activated pop-up sprinkler for allowing for low volume irrigation of lawns and gardens.

2. Description of the Prior Art

The use of sprinkler systems is known in the prior art. More specifically, sprinkler systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art sprinkler systems include U. S. Pat. No. 4,919,332 to Bailey; U.S. Pat. No. 4,729,511 to Citron; U.S. Pat. No. Des. 349,152 to Hayes; U.S. Pat. No. 5,423,486 to Hunter; U.S. Pat. No. 4,790,481 to Ray et al.; and U.S. Pat. No. Des. 294,730 to Karbo.

While these devices fulfill their respective, particular objectives and requirements, the aforementioned patents do not disclose a new water activated pop-up sprinkler. The inventive device includes a cylindrical housing having an open upper end, a closed lower end, a cylindrical side wall therebetween, and a hollow interior. The closed lower end has a tapered pointed end extending downwardly therefrom for penetrating a ground surface. The cylindrical housing has diametrically opposed inlet and outlet connections disposed on the cylindrical side wall downwardly of the open upper end. The connections each have channels extending downwardly within the cylindrical side wall to the closed lower end and meeting centrally within the closed lower end wherein a short channel extending upwardly into communication with the hollow interior. An inner plastic pipe is provided having opposed open ends. A lower open end couples with the short channel of the cylindrical housing. The plastic pipe has a spring disposed therearound. The spring biases the plastic pipe downwardly with respect to the cylindrical housing. A spray nozzle is coupled with an open upper end of the inner plastic pipe. A cap is dimensioned for coupling with the cylindrical housing. The cap has an aperture therethrough dimensioned for receiving the spray nozzle therethrough.

In these respects, the water activated pop-up sprinkler according to the present invention substantially departs from the conventional concepts and designs of the prior art, and in so doing provides an apparatus primarily developed for the purpose of allowing for low volume irrigation of lawns and gardens.

SUMMARY OF THE INVENTION

In view of the foregoing disadvantages inherent in the known types of sprinkler systems now present in the prior art, the present invention provides a new water activated pop-up sprinkler construction wherein the same can be utilized for allowing for low volume irrigation of lawns and gardens.

The general purpose of the present invention, which will be described subsequently in greater detail, is to provide a new water activated pop-up sprinkler apparatus and method which has many of the advantages of the sprinkler systems mentioned heretofore and many novel features that result in a new water activated pop-up sprinkler which is not anticipated, rendered obvious, suggested, or even implied by any of the prior art sprinkler systems, either alone or in any combination thereof.

To attain this, the present invention generally comprises a cylindrical housing having an open upper end, a closed lower end, a cylindrical side wall therebetween, and a hollow interior. The open upper end has a cylindrical extension extending upwardly therefrom. The extension is of a common interior diameter and a reduced outer diameter with respect to the housing. The closed lower end has a tapered pointed end extending downwardly therefrom for penetrating a ground surface. The cylindrical side wall has a pair of diametrically opposed ridges extending a length thereof between the cylindrical extension and the closed lower end. The cylindrical housing has diametrically opposed inlet and outlet connections disposed on the cylindrical side wall downwardly of the open upper end. The connections each have channels extending downwardly within the cylindrical side wall to the closed lower end and meeting centrally within the closed lower end wherein a short channel extending upwardly into communication with the hollow interior. An inner plastic pipe is provided having opposed open ends. A lower open end couples with the short channel of the cylindrical housing. The plastic pipe has a spring disposed therearound. The spring biases the plastic pipe downwardly with respect to the cylindrical housing. A spray nozzle is coupled with an open upper end of the inner plastic pipe. A cap is dimensioned for coupling with the cylindrical extension of the cylindrical housing. The cap has an aperture therethrough dimensioned for receiving the spray nozzle therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new water activated pop-up sprinkler apparatus and method which has many of the advantages of the sprinkler systems mentioned heretofore and many novel features that result in a new water activated pop-up sprinkler which is not anticipated, rendered obvious, suggested, or even implied by any of the prior art sprinkler systems, either alone or in any combination thereof.

It is another object of the present invention to provide a new water activated pop-up sprinkler which may be easily and efficiently manufactured and marketed.

It is a further object of the present invention to provide a new water activated pop-up sprinkler which is of a durable and reliable construction.

An even further object of the present invention is to provide a new water activated pop-up sprinkler which is susceptible of a low cost of manufacture with regard to both materials and labor, and which accordingly is then susceptible of low prices of sale to the consuming public, thereby making such water activated pop-up sprinkler economically available to the buying public.

Still yet another object of the present invention is to provide a new water activated pop-up sprinkler which provides in the apparatuses and methods of the prior art some of the advantages thereof, while simultaneously overcoming some of the disadvantages normally associated therewith.

Still another object of the present invention is to provide a new water activated pop-up sprinkler for allowing for low volume irrigation of lawns and gardens.

Yet another object of the present invention is to provide a new water activated pop-up sprinkler which includes a cylindrical housing having an open upper end, a closed lower end, a cylindrical side wall therebetween, and a hollow interior. The closed lower end has a tapered pointed end extending downwardly therefrom for penetrating a ground surface. The cylindrical housing has diametrically opposed inlet and outlet connections disposed on the cylindrical side wall downwardly of the open upper end. The connections each have channels extending downwardly within the cylindrical side wall to the closed lower end and meeting centrally within the closed lower end wherein a short channel extending upwardly into communication with the hollow interior. An inner plastic pipe is provided having opposed open ends. A lower open end couples with the short channel of the cylindrical housing. The plastic pipe has a spring disposed therearound. The spring biases the plastic pipe downwardly with respect to the cylindrical housing. A spray nozzle is coupled with an open upper end of the inner plastic pipe. A cap is dimensioned for coupling with the cylindrical housing. The cap has an aperture therethrough dimensioned for receiving the spray nozzle therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
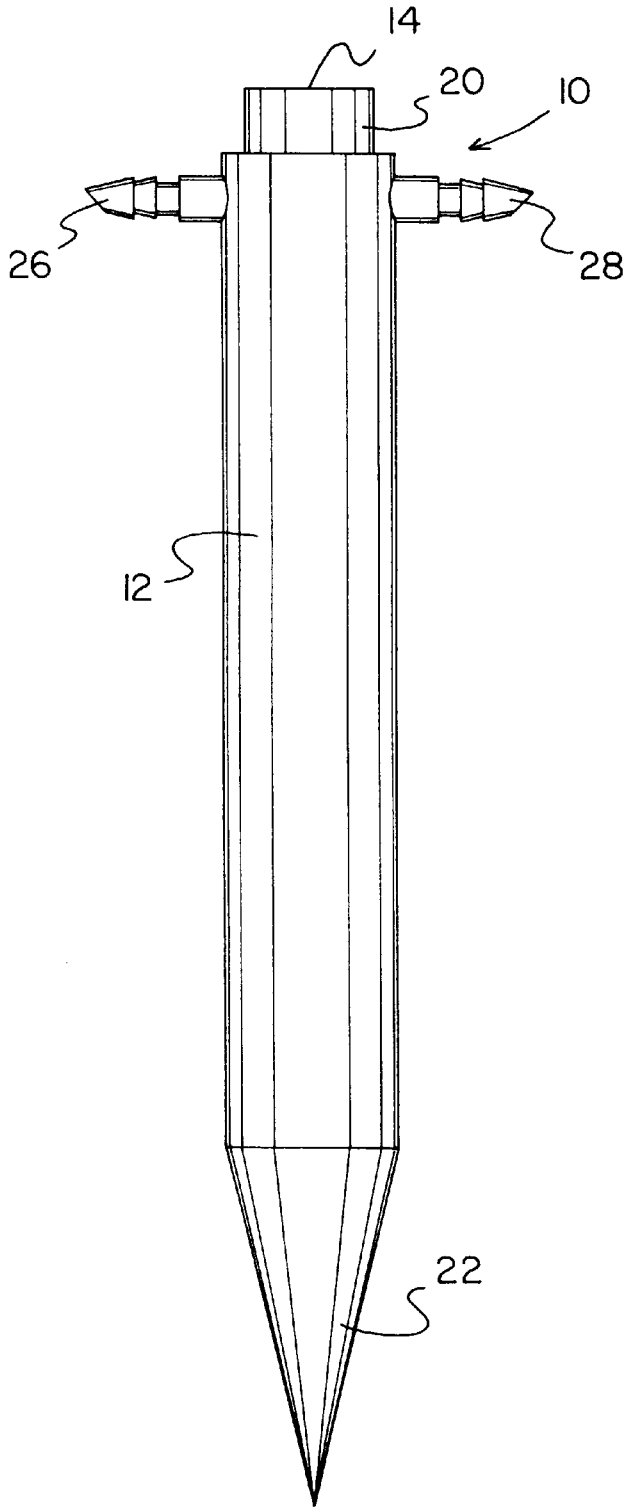
FIG. 1 is a front isometric view of a new water activated pop-up sprinkler according to the present invention.
Figure 2:
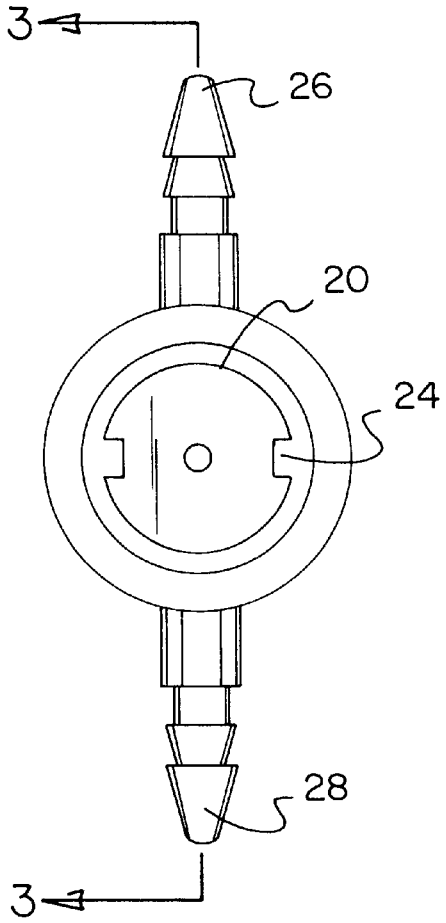
FIG. 2 is a top plan view of the present invention.
Figure 3:
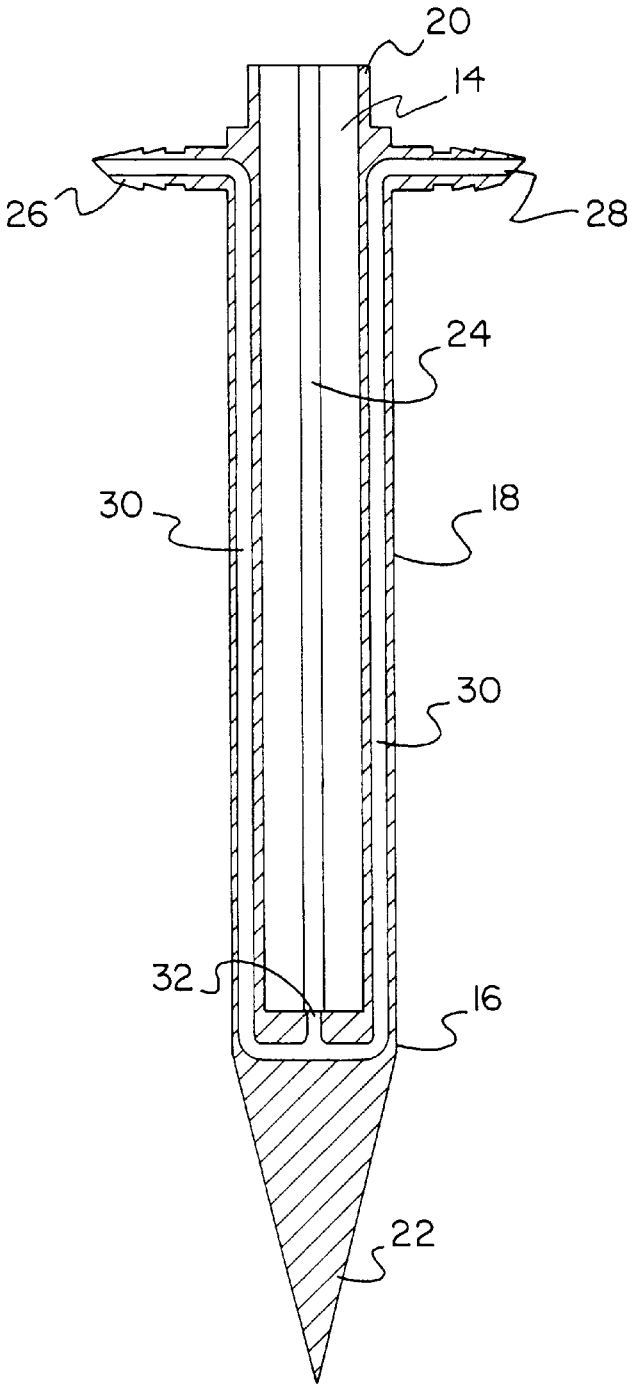
FIG. 3 is a cross-sectional view of the present invention as taken along line 3—3 of FIG. 2.
Figure 4:
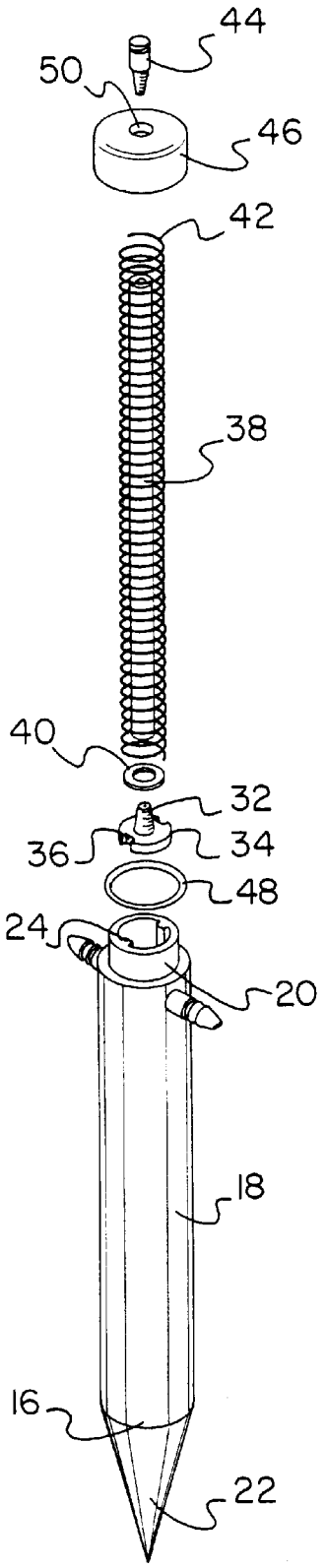
FIG. 4 is an exploded isometric view of the present invention.

With reference now to the drawings, and in particular to FIGS. 1 through 4 thereof, a new water activated pop-up sprinkler embodying the principles and concepts of the present invention and generally designated by the reference numeral 10 will be described.

As best illustrated in FIGS. 1 through 4, the water activated pop-up sprinkler 10 comprises a cylindrical housing 12 having an open upper end 14, a closed lower end 16, a cylindrical side wall 18 therebetween, and a hollow interior. The open upper end 14 has a cylindrical extension 20 extending upwardly therefrom. The extension 20 is of a common interior diameter and a reduced outer diameter with respect to the housing 12. The closed lower end 16 has a tapered pointed end 22 extending downwardly therefrom for penetrating a ground surface. The cylindrical side wall 18 has a pair of diametrically opposed ridges 24 extending a length thereof between the cylindrical extension 20 and the closed lower end 16. The cylindrical housing 12 has diametrically opposed inlet 26 and outlet connections 28 disposed on the cylindrical side wall 18 downwardly of the open upper end 14. The connections 26, 28 each have channels 30 extending downwardly within the cylindrical side wall 18 to the closed lower end 16 and meeting centrally within the closed lower end 16 wherein a short channel 32 extending upwardly into communication with the hollow interior. The short channel 32 includes a lower flange 34 with diametrically opposed recesses 36 formed radially therein corresponding with the diametrically opposed ridges of the housing 12.

An inner plastic pipe 38 is provided having opposed open ends. A lower open end couples with the short channel 32 of the cylindrical housing 12. A washer 40 would be included between the lower open end and the short channel 32. The plastic pipe 38 has a spring 42 disposed therearound. The spring 42 biases the plastic pipe 38 downwardly with respect to the cylindrical housing 12.

A spray nozzle 44 is coupled with an open upper end of the inner plastic pipe 38.

A cap 46 is dimensioned for coupling with the cylindrical extension 20 of the cylindrical housing 12. An O-ring 48 is disposed between the cap 46 and the cylindrical extension 20. The cap 46 has an aperture 50 therethrough dimensioned for receiving the spray nozzle 44 therethrough.

In use, the present invention would be connected to the irrigation system by means of a ¼inch diameter pipe. Ideally, water would enter the cylindrical housing 12 through the inlet connection 26 and travel through the channel 30 and the resulting pressure would cause the inner plastic pipe 38 to slide upward. When the inner pipe 38 reached the top of the housing 12, the water would then be channeled through the sprayer nozzle 44 and onto the lawn or garden. When the water pressure was reduced, the inner pipe 38 simply would retract back into the housing 12 and be covered by the cap 46.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new water activated pop-up sprinkler for allowing for low volume irrigation of lawns and gardens comprising, in combination:

a cylindrical housing having an open upper end, a closed lower end, a cylindrical side wall therebetween, and a hollow interior, the open upper end having a cylindrical extension extending upwardly therefrom, the extension being of a common interior diameter and a reduced outer diameter with respect to the housing, the closed lower end having a tapered pointed end extending downwardly therefrom for penetrating a ground surface, the cylindrical side wall having a pair of diametrically opposed ridges extending a length thereof between the cylindrical extension and the closed lower end, the cylindrical housing having diametrically opposed inlet and outlet connections disposed on the cylindrical side wall downwardly of the open upper end, the connections each having channels extending downwardly within the cylindrical side wall to the closed lower end and meeting centrally within the closed lower end wherein a short channel extending upwardly into communication with the hollow interior;

an inner plastic pipe having opposed open ends, a lower open end coupling with the short channel of the cylindrical housing, the plastic pipe having a spring disposed therearound, the spring biasing the plastic pipe downwardly with respect to the cylindrical housing;

a spray nozzle coupled with an open upper end of the inner plastic pipe; and a cap dimensioned for coupling with the cylindrical extension of the cylindrical housing, the cap having an aperture therethrough dimensioned for receiving the spray nozzle therethrough.

2. A new water activated pop-up sprinkler for allowing for low volume irrigation of lawns and gardens comprising, in combination:

a cylindrical housing having an open upper end, a closed lower end, a cylindrical side wall therebetween, and a hollow interior, the closed lower end having a tapered pointed end extending downwardly therefrom for penetrating a ground surface, the cylindrical housing having diametrically opposed inlet and outlet connections disposed on the cylindrical side wall downwardly of the open upper end, the connections each having channels extending downwardly within the cylindrical side wall to the closed lower end and meeting centrally within the closed lower end wherein a short channel extending upwardly into communication with the hollow interior;

an inner plastic pipe having opposed open ends, a lower open end coupling with the short channel of the cylindrical housing, the plastic pipe having a spring disposed therearound, the spring biasing the plastic pipe downwardly with respect to the cylindrical housing;

a spray nozzle coupled with an open upper end of the inner plastic pipe; and a cap dimensioned for coupling with the cylindrical housing, the cap having an aperture therethrough dimensioned for receiving the spray nozzle therethrough.

3. The water activated pop-up sprinkler as set forth in claim 2 wherein the open upper end of the housing has a cylindrical extension extending upwardly therefrom for engaging the cap.

4. The water activated pop-up sprinkler as set forth in claim 3 wherein the extension is of a common interior diameter and a reduced outer diameter with respect to the housing.

5. The water activated pop-up sprinkler as set forth in claim 2 wherein the cylindrical side wall has a pair of diametrically opposed ridges extending a length thereof between the cylindrical extension and the closed lower end.

* * * * *